US008152564B2

(12) United States Patent
Chang

(10) Patent No.: US 8,152,564 B2
(45) Date of Patent: Apr. 10, 2012

(54) CONNECTOR HAVING PROTECTION COMPONENTS

(76) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 13/186,792

(22) Filed: Jul. 20, 2011

(65) Prior Publication Data

US 2012/0040559 A1 Feb. 16, 2012

(30) Foreign Application Priority Data

Aug. 16, 2010 (TW) ..... 99215704 U

(51) Int. Cl.
*H01R 13/648* (2006.01)

(52) U.S. Cl. ..... 439/607.01

(58) Field of Classification Search ..... 439/607.01, 439/620.01, 620.1, 676
See application file for complete search history.

(56) References Cited

U.S. PATENT DOCUMENTS 5,587,884 A * 12/1996 Raman ..... 361/728
5,647,767 A * 7/1997 Scheer et al. ..... 439/620.17
6,227,911 B1 * 5/2001 Boutros et al. ..... 439/620.18
6,431,764 B1 * 8/2002 Scharf et al. ..... 385/88
6,497,588 B1 * 12/2002 Scharf et al. ..... 439/607.38
6,775,121 B1 * 8/2004 Chaudhry ..... 361/111
6,881,096 B2 * 4/2005 Brown et al. ..... 439/620.01
6,916,206 B2 * 7/2005 Ferentz ..... 439/620.01
7,018,242 B2 * 3/2006 Brown et al. ..... 439/676
7,040,927 B1 * 5/2006 Liu ..... 439/620.2
7,044,779 B1 * 5/2006 Liu ..... 439/541.5
7,153,163 B2 * 12/2006 Lewis et al. ..... 439/620.11
7,207,181 B2 * 4/2007 Murray et al. ..... 62/150
7,309,260 B2 * 12/2007 Brower et al. ..... 439/676
7,367,851 B2 * 5/2008 Machado et al. ..... 439/676
7,429,178 B2 * 9/2008 Givens et al. ..... 439/79
7,618,297 B2 * 11/2009 Wang ..... 439/676
7,658,648 B2 * 2/2010 Aekins ..... 439/620.11
7,674,136 B2 * 3/2010 Steinke et al. ..... 439/676
7,690,941 B2 * 4/2010 Caveney et al. ..... 439/487
7,786,009 B2 * 8/2010 Machado et al. ..... 438/676

* cited by examiner

*Primary Examiner* — Tulsidas C Patel
*Assistant Examiner* — Vladimir Imas
(74) *Attorney, Agent, or Firm* — Chun-Ming Shih; HDLS IPR Services

(57) ABSTRACT

A connector having protection components includes an insulation body, a signal transmission module provided in the insulation body, a first protection component set and a second protection component set both electrically connected to the signal transmission module. The signal transmission module includes a circuit board and an input terminal set and an output terminal set electrically connected to the circuit board. The first protection component set is electrically connected between the input terminal set and the output terminal set for protection between the lines. The second protection component set is electrically connected between the first protection component set and a grounding line, thereby providing protection between the lines and a grounding line.

17 Claims, 9 Drawing Sheets

CONNECTOR HAVING PROTECTION COMPONENTS

BACKGROUND OF THE INVENTION

1. Field of the Invention

The present invention relates to a connector, and in particular to a connector in which a plurality of protection components is provided.

2. Description of Prior Art

With the advancement of science and technology as well as the rapid development of semiconductor industry, computer has become a necessary electronic product in our daily life. Recently, owing to the rapid development of Internet, a user can use one computer to access the Internet for browsing data and communicating with other users in the Internet.

In addition to novel wireless network technology, a mother board of the modern computer is provided with a network connector, such as RJ-45 connector. The network connector is electrically connected to an external cable, thereby connecting the computer to the Internet.

However, the above-mentioned external cable such as the network line or an optical fiber cable, is usually provided outside a building. Thus, when a high voltage is generated in the external cable due to static electricity or lightening, the high voltage will be conducted to the network connector of the computer by the external cable, which makes the mother board electrically connected to the network connector to burn down. In view of this, the existing network connector is provided with a surge protection component, whereby the problem that the computer suffers damage or burns down due to the transient high voltage can be solved.

There are several reasons for high-voltage surge generation. Thus, the value of the generated high-voltage surge cannot be expected. If the generated high-voltage surge is larger than the maximum of the surge protection component which it can withstand, the sure protection component cannot block the surge completely. Further, even the sure protection component blocks the surge, a small current may still pass through the surge protection component to generate a voltage entering the connector. As a result, the generated voltage is still larger than the working voltage of the integrated circuit (IC) inside the connector, so that the integrated circuit (IC) may burn down.

SUMMARY OF THE INVENTION

The present invention is to provide a connector having protection components. The protection components are electrically connected between lines as well as the lines and a grounding line, thereby increasing the capability of the connector for withstanding the high-voltage surge generated by static electricity or lightening.

The present invention provides a connector having protection components, which includes an insulation body, a signal transmission module provided in the insulation body, a first protection component set and a second protection component set both electrically connected to the signal transmission module. The signal transmission module includes a circuit board and an input terminal set and an output terminal set both electrically connected to the circuit board. The first protection component set is electrically connected between the input terminal set and the output terminal set for protection between the lines. The second protection component set is electrically connected between the first protection component set and a grounding line, thereby protecting the lines and a grounding line.

In comparison with prior art, the present invention has advantageous features as follows. A gas discharge tube, a transient voltage suppressor, and a transformer are used as surge protection components for protection between the lines as well as the lines and a grounding line. In this way, the capability of the connector for protecting against static electricity and lightening can be increased. Further, since the gas discharge tube has a low allowance, a smaller signal distortion, easy assembly and low cost, using the gas discharge tube as a protection component increases the performance and efficiency of the connector.

DETAILED DESCRIPTION OF THE INVENTION

In order to better understand the features and technical contents of the present invention, a detailed description relating thereto will be made with reference to the accompanying drawings. It is noteworthy to point out that the drawings is provided for the illustration purpose only, but not intended for limiting the scope of the present invention.

Figure 1:
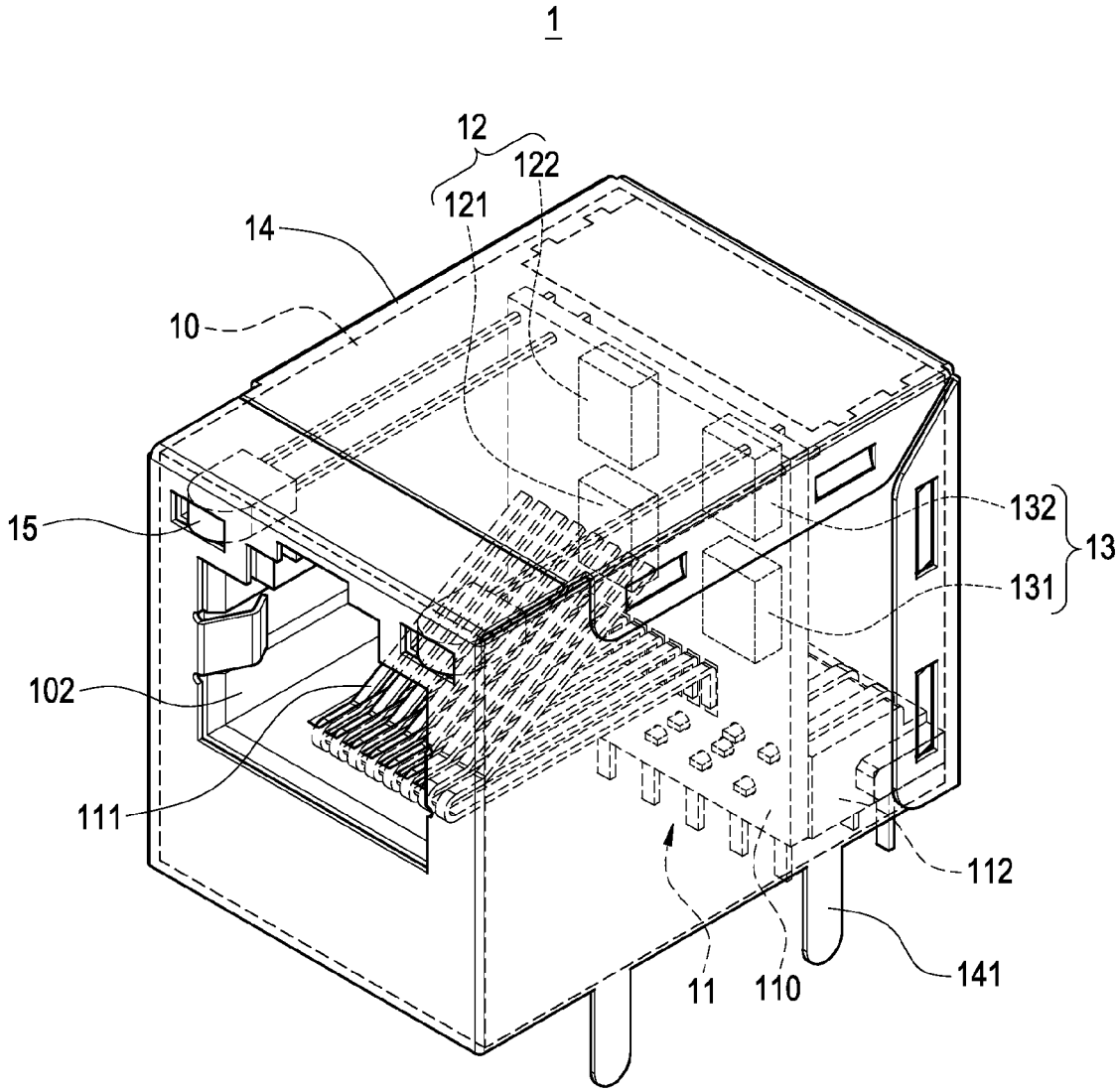
FIG. 1 is a perspective view showing the external appearance of a preferred embodiment of the present invention.
Figure 2:
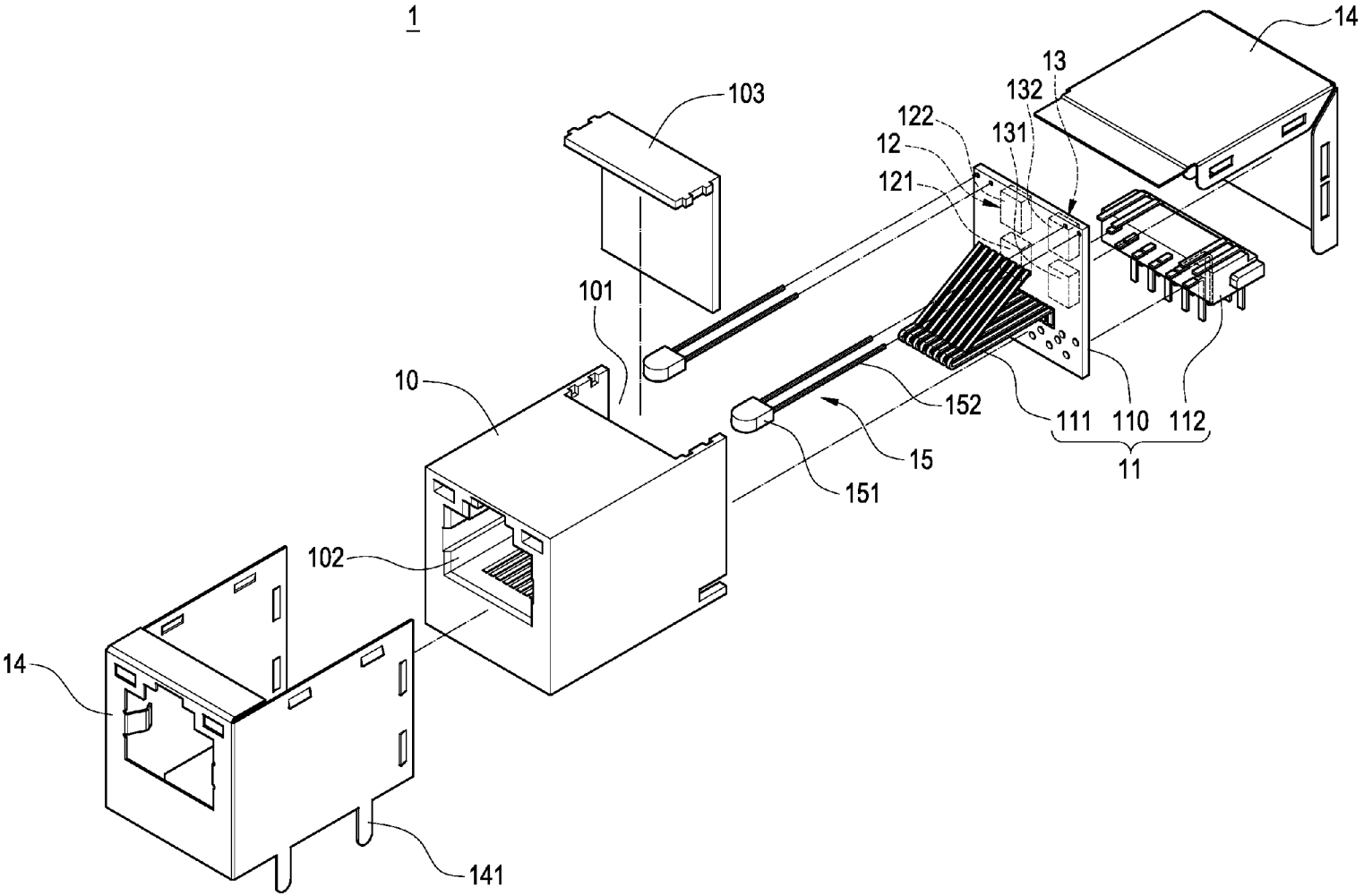
FIG. 2 is an exploded perspective view showing a preferred embodiment of the present invention.

Please refer to FIGS. 1 and 2. FIG. 1 is a perspective view showing the external appearance of a preferred embodiment of the present invention. FIG. 2 is an exploded perspective view showing a preferred embodiment of the present invention. The present invention provides a connector 1, which includes an insulation body 10, a signal transmission module 11, a first protection component set 12, a second protection component set 13, and a metallic casing 14 covering the above-mentioned components.

Figure 3:
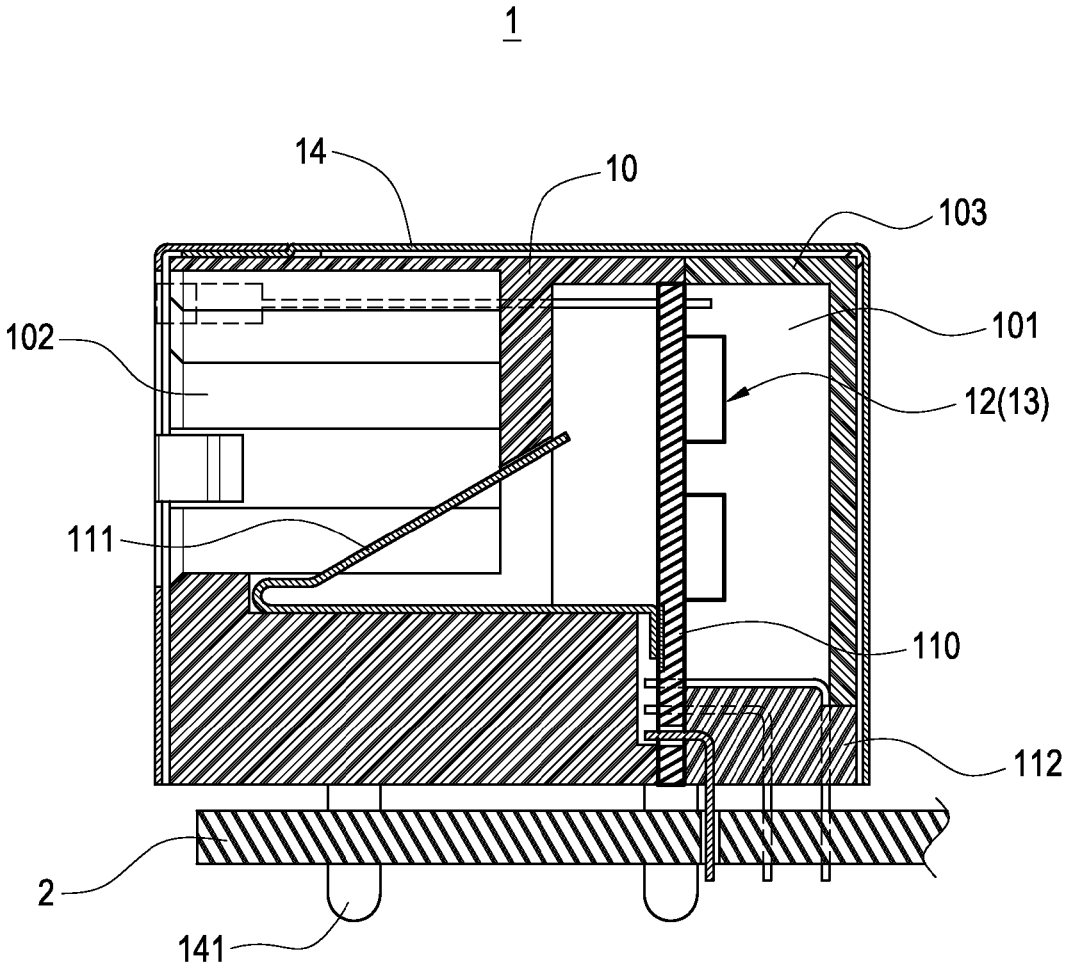
FIG. 3 is a side view showing a preferred embodiment of the present invention.

The interior of the insulation body 10 has an accommodating space 101 for accommodating the signal transmission module 11, the first protection component set 12, and the second protection component set 13. One side of the insulation body 10 is provided with a through trough 102. The signal transmission module 11 includes a circuit board 110, and an input terminal set 111 and an output terminal set 112 both electrically connected to the circuit board 110. The input terminal set 111 passes through the accommodating space 101 and extends into the through trough 102 to be electrically connected to an external cable. The output terminal set 112 extends downwards from the circuit board 110 to be electrically connected to a mother board 2 (FIG. 3).

As shown in the figures, the through trough 102 allows an external cable of RJ-45 standard to be connected therein. The input terminal set 111 and the output terminal set 112 are configured to transmit signals of RJ-45 standard, but they are not limited thereto.

The first protection component set 12 is electrically connected to the circuit board 110 of the signal transmission module 11, and it is electrically connected between the input terminal set 111 and the output terminal set 112 for protection between the lines. The first protection component set 12 includes a transformer 121 and a first surge protection component 122. The transformer 121 may be, for example, an isolation transformer, but it is not limited thereto. The second protection component set 13 is electrically connected to the circuit board 110 of the signal transmission module 11, and it is electrically connected to the first protection component set 12 and the metallic casing 14. By this arrangement, the second protection component set 13 is grounded via a grounding pin 141 provided on the bottom of the metallic casing 14 for protection between the lines and a grounding line. The second protection component set 13 includes a gas discharge tube 131 and a second surge protection component 132. The first surge protection component 122 may be a transient voltage suppressor. The second surge protection component 132 may be a high voltage capacitor or a transient voltage suppressor. In the present embodiment, the first protection component set 12 and the second protection component set 13 are embodied as an integrated circuit (IC) respectively, but they are not limited thereto.

According to the above, the connector 1 of the present invention includes at least four protection components, which comprises the transformer 121 and the first surge protection component 122 both electrically connected between the lines, and the gas discharge tube 131 and the second surge protection component 132 both electrically connected between the line and the grounding line. However, the number of the protection components can be changed based on the safety requirement of the connector 1. For example, if the first surge protection component 122 and the second surge protection component 132 are transient voltage suppressors, they can withstand a transient boost voltage of approximate 1 KV. If the voltage generated by the static electricity or lightening is larger than 1 KV, the connector 1 will still burn down. Further, the gas discharge tube 131 is capable of withstanding a transient boost voltage of approximate 3 KV. By this arrangement, the connector 1 having the first protection component set 12 and the second protection component set 13 can withstand a transient boost voltage of 3 KV without burning down. However, the above is merely a preferred embodiment of the present invention, but it does not intend to limit the scope of the present invention.

A plurality of light-emitting elements 15 is disposed in the accommodating space 101. One end of each of the light-emitting elements 15 has a light-emitting body 151. The light-emitting bodies 151 extend forwards to protrude out of the metallic casing 14. The other end of each of the light-emitting elements 15 away from the light-emitting body 151 has an electrode pin 152. The electrode pins 152 are electrically connected to the circuit board 110 to receive the necessary electricity for light emission. The light-emitting elements 15 may be further electrically connected to a third surge protection component 153 (FIG. 9), thereby protecting the light-emitting elements 15 from burning down due to a high-voltage surge.

The insulation body 10 further has a rear cover plate 103 for covering the components in the accommodating space 101.

Please refer to FIG. 3, which is a side view showing a preferred embodiment of the present invention. The connector 1 is electrically connected to an external cable via the through trough 102 and receives external signals via the input terminal set 111. When a high-voltage surge is generated, the connector 1 can be protected against surge via the first protection component set 12 on the circuit board 110. The first protection component set 12 absorbs and blocks the transient boost voltage/current, and then transmits signals to the output terminal set 112, thereby transmits the signals to the mother board 2 electrically connected to the output terminal set 112. In this way, the first protection component set 12 can protect the surge generated between the lines, so that the mother board 2 can be protected from burning down due to the transient boost voltage/current.

Further, the connector 1 absorbs and blocks the voltage/current via the second protection component set 13. The metallic casing 14 releases the voltage/current absorbed by the second protection component set 13 to the outside. In this way, the second protection component set 13 can protect a surge generated between the line and the grounding line, so that the mother board 2 can be protected from burning down due to the transient boost voltage/current.

Figure 4:
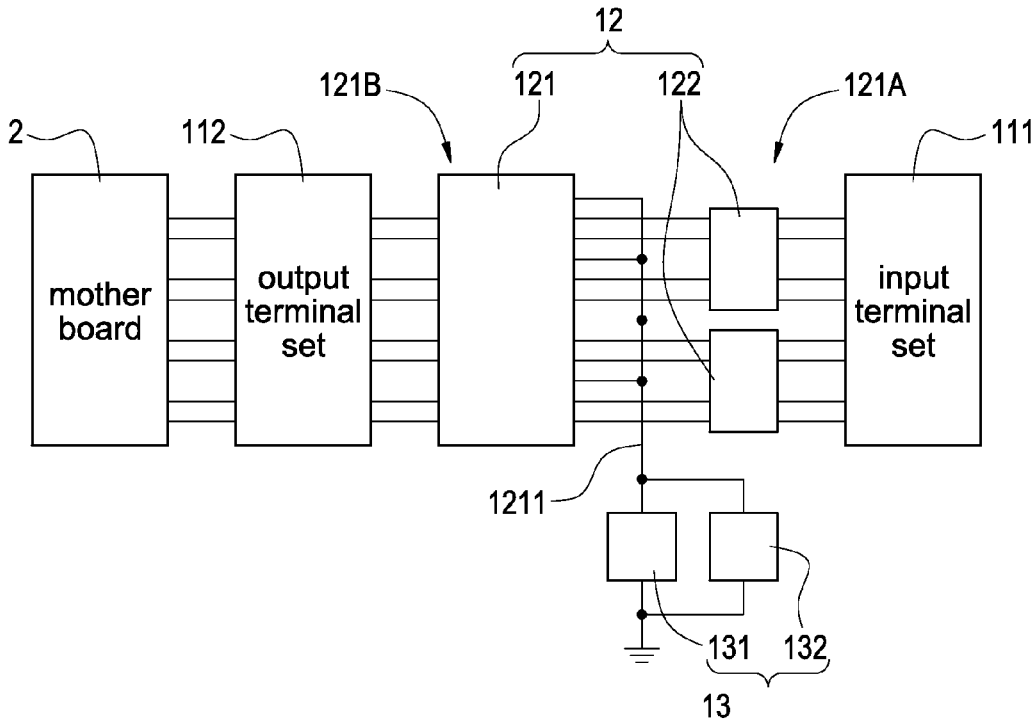
FIG. 4 is a block view showing the protection component of a preferred embodiment of the present invention.

Please refer to FIG. 4, which is a block view showing a protection component in accordance with a preferred embodiment of the present invention. Please also refer to FIG. 8, which is a schematic view showing the circuit arrangement of FIG. 4. As mentioned in the above, the first protection component set 12 includes the transformer 121 and the first surge protection component 122. The transformer 121 has a primary coil 121A and a secondary coil 121B. The primary coil 121A is electrically connected to the input terminal set 111 of the signal transmission module 11. The secondary coil 121B is electrically connected to the output terminal set 112 of the signal transmission module 11. The first surge component 122 is electrically connected between the primary coil 121A of the transformer 121 and the input terminal set 111. The first surge protection component 122 and the transformer 121 constitute the first protection component set 12, thereby providing protection between the lines.

According to the above, the primary coil 121A of the transformer 121 has a center tap portion 1211. The second protection component set 13 (including the gas discharge tube 131 and the second surge protection component 132) is electrically connected to the center tap portion 1211 and the grounding line (i.e. the metallic casing 14). By this arrangement, the second protection component set 13 can provide protection between the lines and the grounding line.

Figure 8:
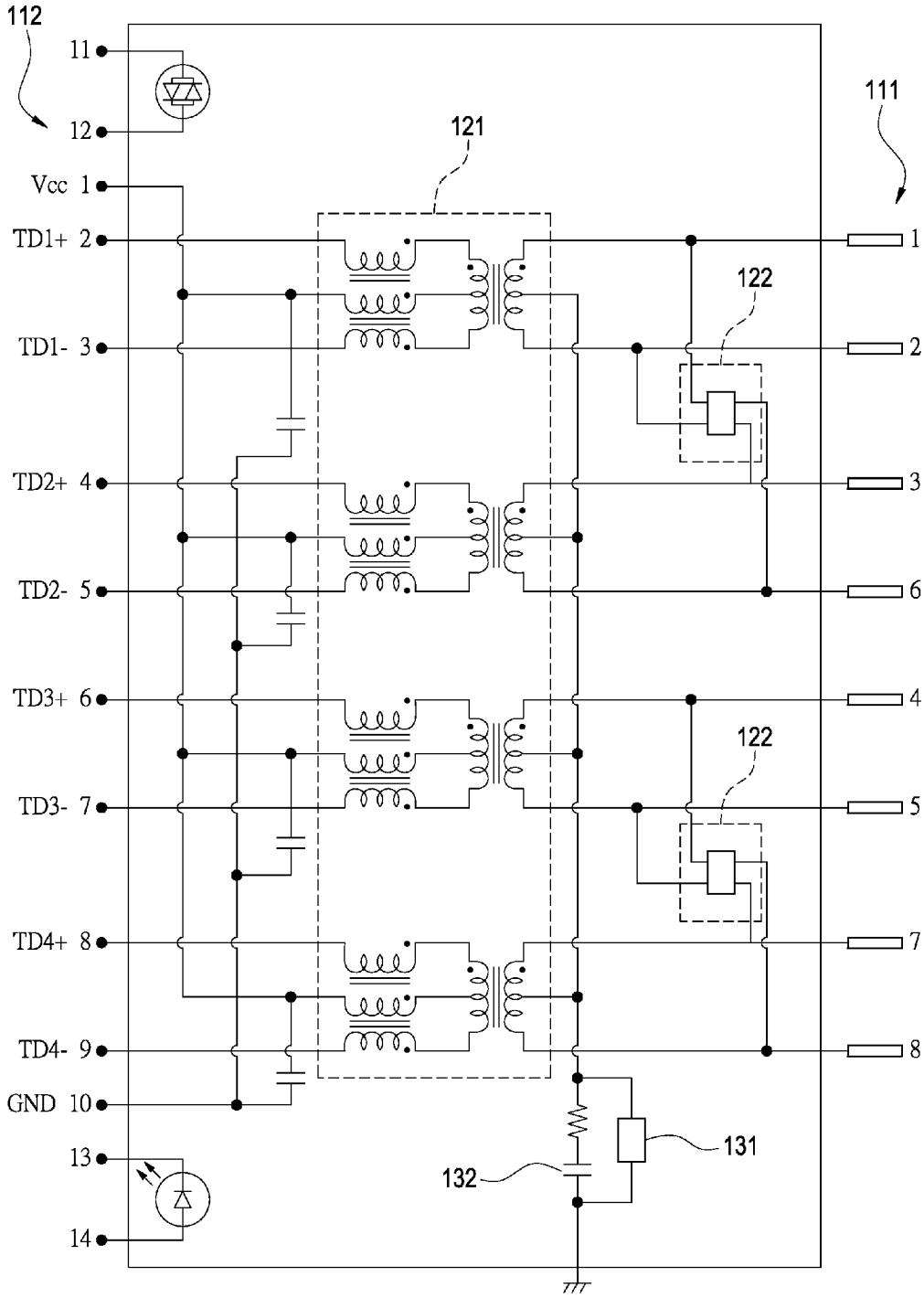
FIG. 8 is a schematic view showing the circuit arrangement of the protection component in accordance with another preferred embodiment of the present invention.
Figure 9:
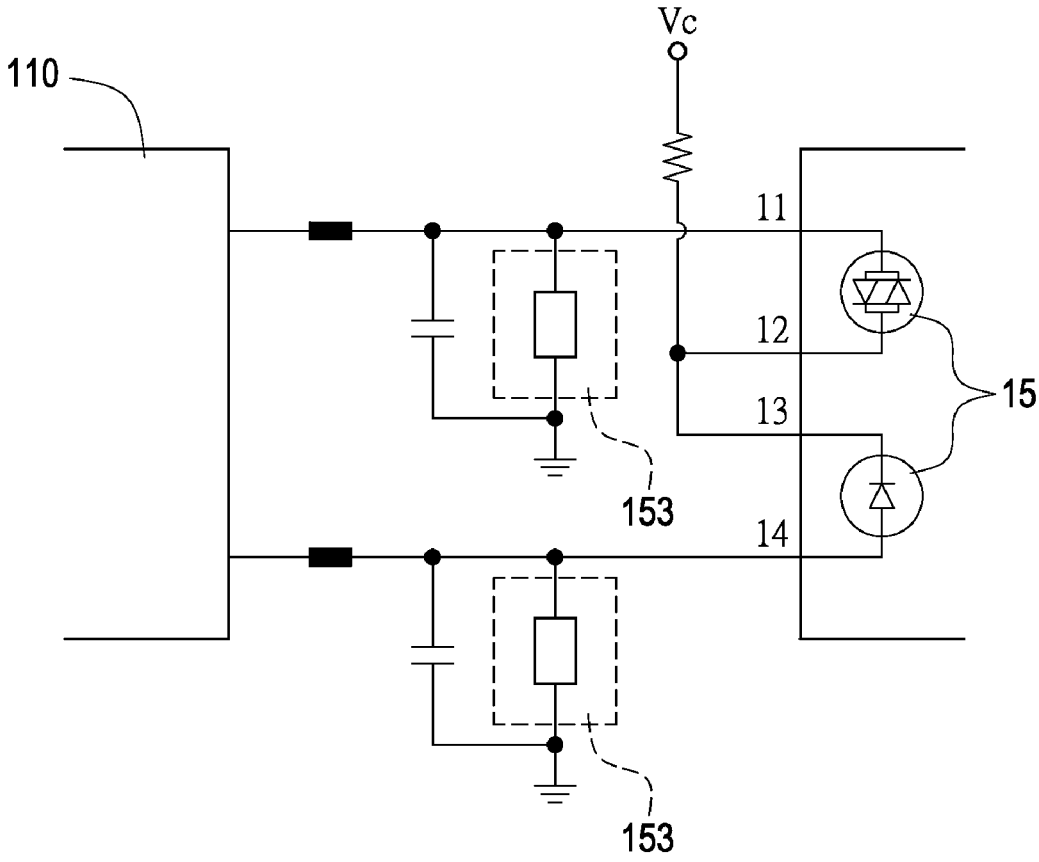
FIG. 9 is a schematic view showing the circuit arrangement of a light-emitting element in accordance with another preferred embodiment of the present invention.

Please refer to FIG. 9, which is a schematic view showing the circuit arrangement of a light-emitting element in accordance with a preferred embodiment of the present invention. As shown in FIG. 8, the light-emitting elements 15 are electrically connected to the circuit board 110. The light-emitting elements 15 are further electrically connected to the third surge protection component 153. By this arrangement, the high-voltage surge can be absorbed by the third surge protection element 153 and released via the grounding line. Further, the third surge protection component 153 protects the light-emitting elements 15 from burning down. The third surge protection component 153 is a transient voltage suppressor, but it is not limited thereto.

Figure 5:
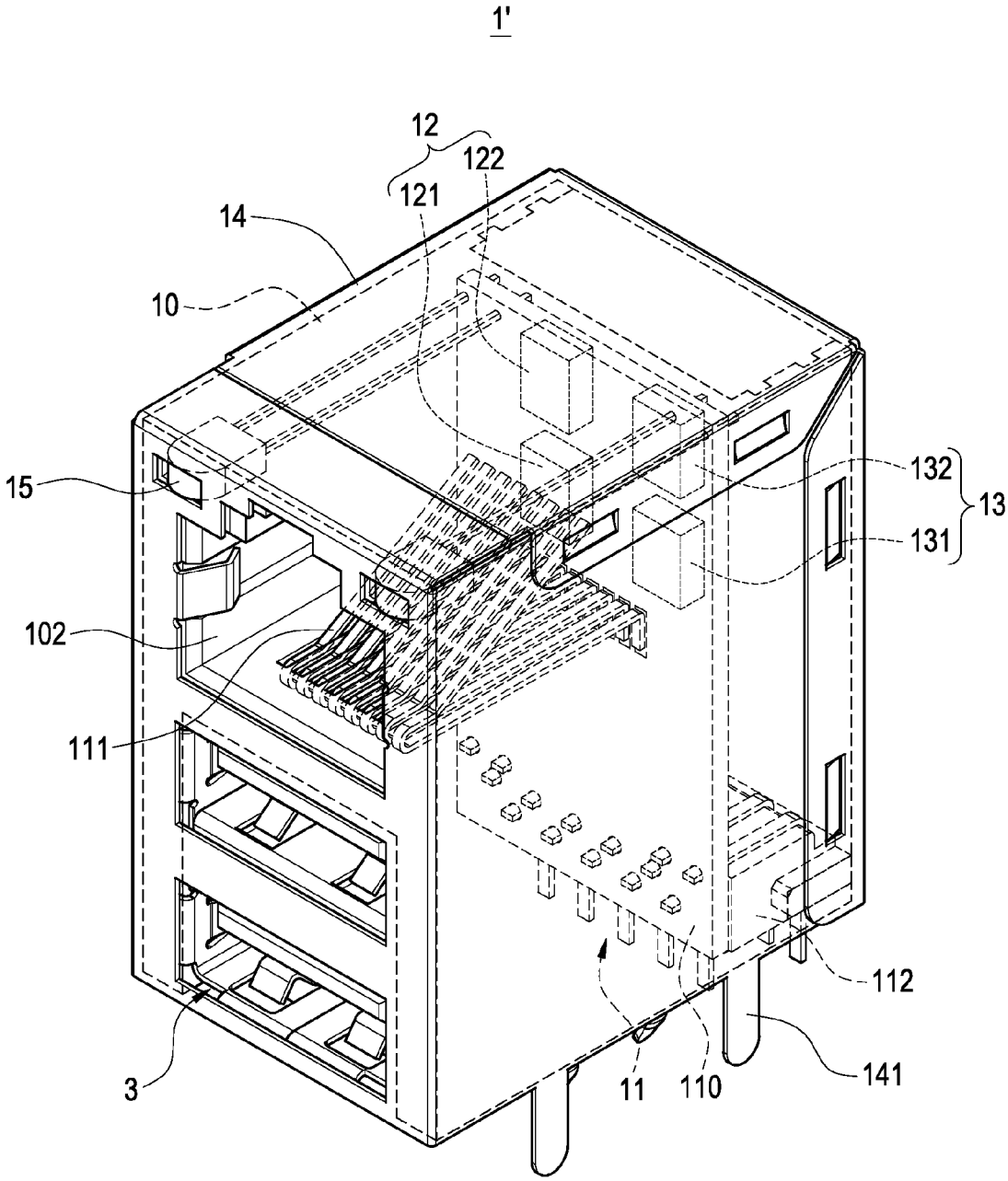
FIG. 5 is a perspective view showing the external appearance of another preferred embodiment of the present invention.
Figure 6:
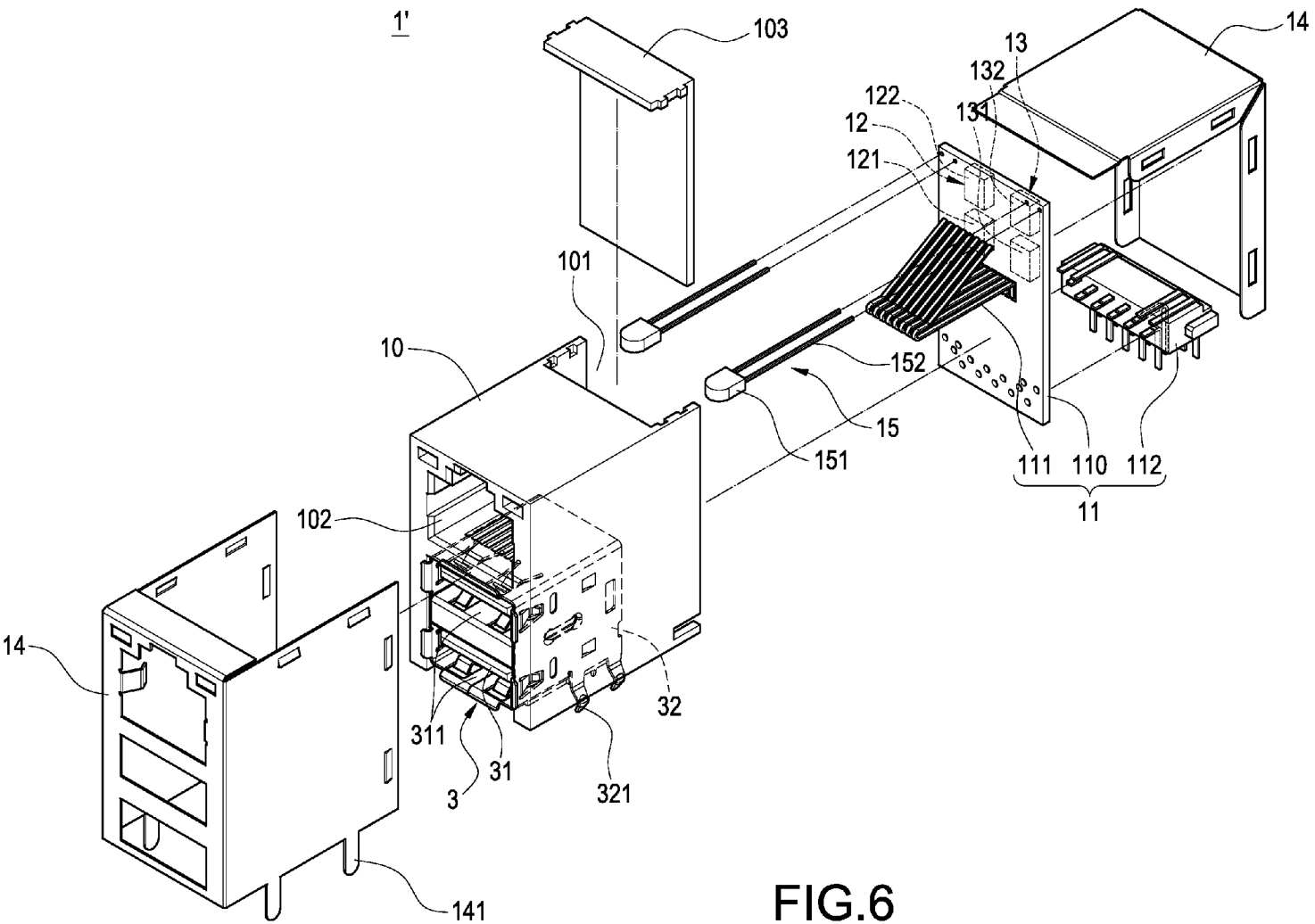
FIG. 6 is an exploded perspective view showing another preferred embodiment of the present invention.
Figure 7:
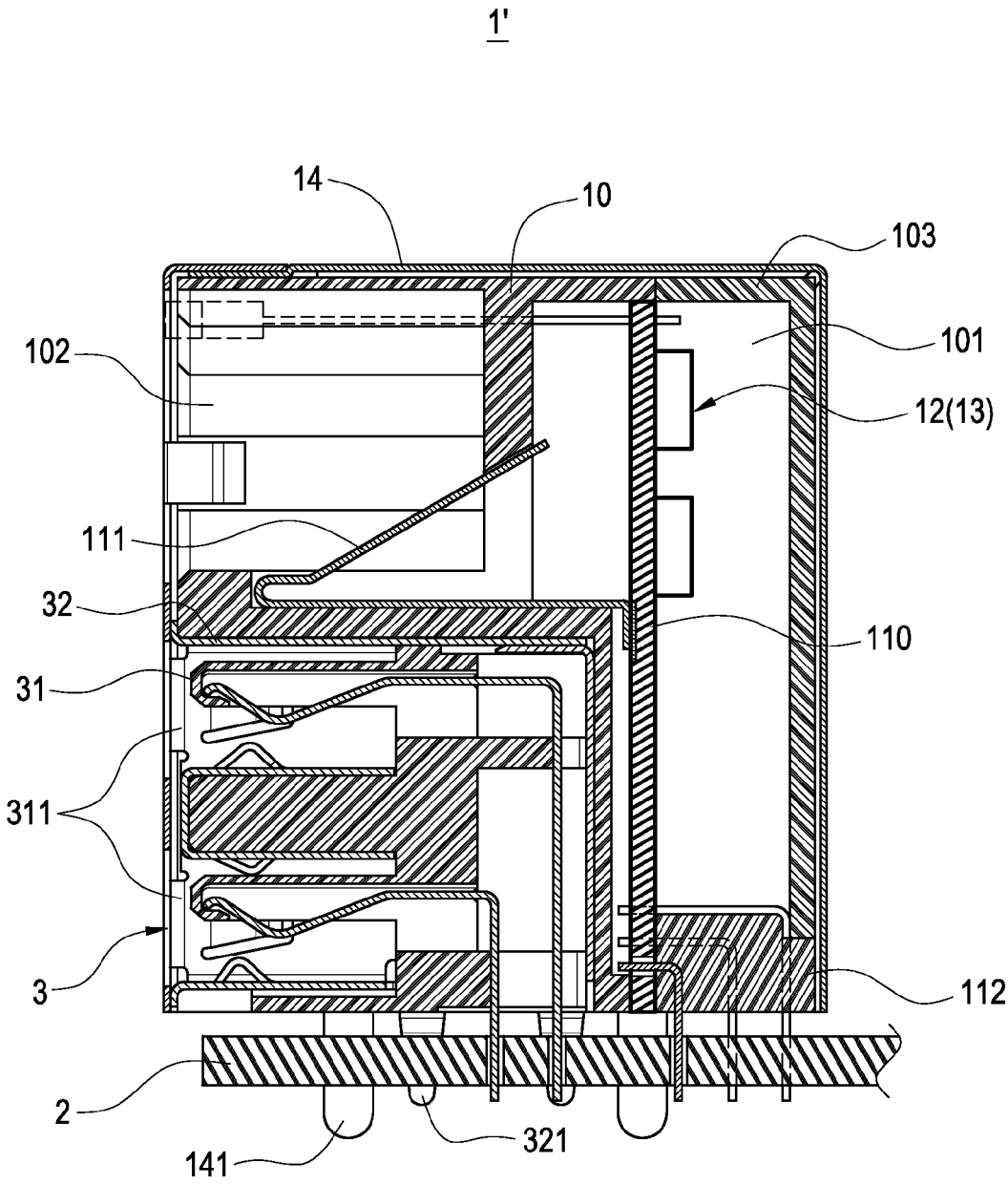
FIG. 7 is a side view showing another preferred embodiment of the present invention.

Please refer to FIGS. 5, 6 and 7. FIG. 5 is a perspective view showing the external appearance of another preferred embodiment of the present invention. FIG. 6 is an exploded perspective view showing another preferred embodiment of the present invention. FIG. 7 is a side view showing another preferred embodiment of the present invention. As shown in these figures, the connector of the present invention may be configured as a composite connector 1'. In the connector 1', a connector module 3 may be further disposed in the accommodating space 101. The connector module 3 shown in these figures is a Universal Serial Bus (USB), but it is not limited thereto. The connector module 3 and the RJ-45 connector are disposed together, thereby saving a space on the mother board 2 for arranging the lines.

The connector module 3 has an insulation casing 31. The interior of the insulation casing 31 is formed with a plurality of ports 311. The connector module 3 further includes a second metallic casing 32 for covering the insulation casing 31 and providing a metallic shield effect for the connector module 3. The bottom of the second metallic casing 32 is provided with a second grounding pin 321. The connector module 3 is grounded to the second grounding pin 321.

The metallic casing 14 has the grounding pin 141 for providing a grounding effect to the connector 1. The second metallic casing 32 has the second grounding pin 321 for providing a grounding effect to the connector module 3. It should be noted that, the two metallic casings 14, 32 are electrically connected with each other. One of the two metallic casings 14, 32 is provided with a common grounding pin (i.e., the grounding pin 141 or the second grounding pin 321). The second protection component set 13 is electrically connected to the metallic casing 14. The grounding pin 141 or the second grounding pin 321 can release the absorbed voltage/current.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A connector having protection components, disposed on a mother board and including:

an insulation body having an accommodating space therein, one side of the insulation body being provided with a through trough;

a signal transmission module disposed in the accommodating space, the signal transmission module having a circuit board and an input terminal set and an output terminal set both electrically connected to the circuit board, wherein the input terminal set passes through the accommodating space and extends into the through trough to be electrically connected to an external cable, the output terminal set is electrically connected to the mother board;

a first protection component set electrically connected to the circuit board of the signal transmission module, the first protection component set being electrically connected between the input terminal set and the output terminal set;

a metallic casing covering the insulation body for providing a metal shield effect; and a second protection component set electrically connected to the circuit board of the signal transmission module, the second protection component set being electrically connected to the first protection component set and the metallic casing.

2. The connector having protection components according to claim 1, wherein the through trough is connected to an external cable of RJ-45 standard, and the input terminal set and the output terminal set are configured to transmit signals of RJ-45 standard.

3. The connector having protection components according to claim 2, wherein the first protection component set includes a transformer and a first surge protection component.

4. The connector having protection components according to claim 3, wherein the transformer is an isolation transformer.

5. The connector having protection components according to claim 3, wherein the transformer has a primary coil and a secondary coil, the primary coil is electrically connected to the input terminal set, the secondary coil is electrically connected to the output terminal set, and the first surge protection component is electrically connected between the primary coil of the transformer and the input terminal set.

6. The connector having protection components according to claim 5, wherein the first surge protection component is a transient voltage suppressor.

7. The connector having protection components according to claim 5, wherein the second protection component set includes a gas discharge tube and a second surge protection component.

8. The connector having protection components according to claim 7, wherein the primary coil of the transformer has a center tap portion, the gas discharge tube and the second surge protection component are electrically connected to the center tap portion of the primary coil and the metallic casing.

9. The connector having protection components according to claim 8, wherein the second surge protection component is a high-voltage capacitor.

10. The connector having protection components according to claim 8, wherein the second surge protection component is a transient voltage suppressor.

11. The connector having protection components according to claim 2, further including a connector module disposed in the accommodating space, the connector module having a second metallic casing electrically connected to the metallic casing, one of the metallic casing and the second metallic casing providing a common grounding pin.

12. The connector having protection components according to claim 11, wherein the connector module is a Universal Serial Bus (USB) connector.

13. A connector having protection components, disposed on a mother board and including:

an insulation body having an accommodating space therein, one side of the insulation body being provided with a through trough;

a signal transmission module disposed in the accommodating space, the signal transmission module having a circuit board and an input terminal set and an output terminal set both electrically connected to the circuit board, wherein the input terminal set passes through the accommodating space and extends into the through trough to be electrically connected to an external cable, the output terminal set is electrically connected to the mother board;

a metallic casing covering the insulation body for providing a metal shield effect; and at least four protection components, electrically connected to the circuit board of the signal transmission module and including a transformer, a gas discharge tube, a first surge protection component and a second surge protection component;

wherein the transformer has a primary coil and a secondary coil, the primary coil is electrically connected to the input terminal set, the secondary coil is electrically connected to the output terminal set, the first surge protection component is electrically connected between the input terminal set and the primary coil, the primary coil has a center tap portion, the gas discharge tube and the second surge protection component are electrically connected to the center tap portion of the primary coil and the metallic casing.

14. The connector having protection components according to claim 13, wherein the transformer is an isolation transformer.

15. The connector having protection components according to claim 13, further including a connector module disposed in the accommodating space, the connector module having a second metallic casing electrically connected to the metallic casing, one of the metallic casing and the second metallic casing providing a common grounding pin.

16. The connector having protection components according to claim 15, wherein the through trough is connected to an external cable of RJ-45 standard, the input terminal set and the output terminal set are configured to transmit signals of RJ-45 standard, and the connector module is a USB connector.

17. The connector having protection components according to claim 16, wherein the first surge protection component is a transient voltage suppressor, and the second surge protection component is high-voltage capacitor or a transient voltage suppressor.

* * * * *